US006259049B1

(12) United States Patent
Nakai

(10) Patent No.: US 6,259,049 B1
(45) Date of Patent: Jul. 10, 2001

(54) KEY SWITCH DEVICE WITH LOW-PROFILE KEY TOP WHICH GIVES THREE-DIMENSIONAL APPEARANCE AND LOOKS THICKER THAN ACTUAL ONE

(75) Inventor: Takashi Nakai, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 09/588,445

(22) Filed: Jun. 6, 2000

(30) Foreign Application Priority Data

Jun. 7, 1999 (JP) ..... 11-159298

(51) Int. Cl.[7] ..... H01H 9/18; H01H 3/12
(52) U.S. Cl. ..... 200/341; 200/308; 200/5 A
(58) Field of Search ..... 200/5 A, 517, 200/341, 345, 308–314; 400/472, 487, 488, 490, 493–495

(56) References Cited

U.S. PATENT DOCUMENTS 4,602,878 * 7/1986 Merner et al. ..... 400/110
5,779,030 7/1998 Ikegami et al. ..... 200/344
5,790,103 * 8/1998 Willner ..... 345/168
5,954,437 * 9/1999 Wen-Hung ..... 400/487
5,995,024 * 11/1999 Kambayashi et al. ..... 341/22
6,060,676 * 5/2000 Pan ..... 200/344

* cited by examiner

*Primary Examiner*—Michael Friedhofer
(74) *Attorney, Agent, or Firm*—Brinks Hofer Gilson & Lione

(57) ABSTRACT

A key switch device having a key top colored in a dark shade on the right and front side surfaces, in a light shade on the top surface, and in an intermediate shade between the color of the right and front side surfaces and the color of the top surface, on the left and rear side surfaces. Because of these different color shades, the right and front side surfaces look as if shaded; and the top surface presents a thick, three-dimensional appearance regardless of the direction of light falling thereon. That is, the key top, being low-profile, looks thick.

10 Claims, 2 Drawing Sheets

KEY SWITCH DEVICE WITH LOW-PROFILE KEY TOP WHICH GIVES THREE-DIMENSIONAL APPEARANCE AND LOOKS THICKER THAN ACTUAL ONE

BACKGROUND OF THE INVENTION

1. Field of the Invention

The present invention relates to a key switch device, and more particularly, to a key switch device suitable for use on a keyboard to be used as various input devices of a personal computer, word processor, etc.

2. Description of Related Art

A conventional key switch device (not shown) is provided with a vertically movable key top in the upper position and supported at the underside with a supporting member assembled in a criss-cross fashion.

Below the key top a metal plate is disposed; on the upper surface of the metal plate, a membrane sheet is placed. A rubber spring is interposed between the membrane sheet and the key top.

With the depressing and releasing operation of the key top, the key top is moved up and down between the upper and lower positions by the elastic force of the rubber spring. When the key top is in the lower position, the switching portion of the membrane switch is turned on by the rubber spring.

The conventional key switch device stated above is adopted in a portable equipment such as a notebook PC. With a recent rapid trend of downsizing portable equipment, there has been a keen demand for a low-profile key switch device.

To meet the demand for a low-profile conventional key switch device (not shown), therefore, the metal plate for attaching the membrane switch has been decreased in thickness and the key top has been reduced in thickness to a minimum.

In the conventional key switch device described above, since the key top is decreased in thickness to about 2 mm to meet the demand for reduction in thickness, there arises such a disadvantage that the key top has no three-dimensional appearance, being deteriorated in appearance.

SUMMARY OF THE INVENTION

In view of the above-described disadvantage inherent in the heretofore known key switch device, it is an object of the present invention to provide a key switch device capable of giving the key top the three-dimensional appearance if the key top is thin, thereby improving the quality of the key top.

As the first means of solving the problem stated above, the key switch device of the present invention has a key top and a membrane sheet which makes a switching operation with the up-and-down movement of the key top. The outer peripheral surface of the key top is colored in different shades.

As the second means of solving the problem stated above, the key top is boat-shaped and has an approximately trapezoidal sectional form. The outer peripheral surface is composed of a top surface and four side surfaces, that is, right, left, front and rear side surfaces. The mutually adjacent right and left side surfaces and the mutually adjacent left and rear side surfaces, and the top surface, are colored in different shades.

Further as the third means of solving the problem stated above, the right and front side surfaces of the key top are colored in a dark shade; the top surface is colored in a light shade; and the left and rear side surfaces are colored in an intermediate shade between the color of the right and front side surfaces and the color of the top surface.

Further as the fourth means of solving the problem stated above, the key switch device has the key top and the membrane sheet for performing switching operation with the up-and-down movement of the key top. The key top is provided with different degrees of luster on the outer peripheral surface.

Further as the fifth means of solving the problem stated above, the key top is boat-shaped and has an approximately trapezoidal sectional form. The outer peripheral surface is composed of a top surface and four side surfaces, that is, right, left, front and rear side surfaces. The mutually adjacent right and left side surfaces and the mutually adjacent left and rear side surfaces, and the top surface, are colored in different degrees of luster.

Further as the sixth means of solving the problem stated above, the right and front side surfaces of the key top are satinized to lower the luster degree, while the top surface is finished smooth to provide a higher luster degree. The left and rear side surfaces are roughened to provide intermediate luster between the luster of the right and front side surfaces and the luster of the top surface.

DESCRIPTION OF THE PREFERRED EMBODIMENTS

Now, preferred embodiments of a key switch device according to the p resent invention will be described with reference to the accompanying drawings FIGS. 1 to 4.

Figure 1:
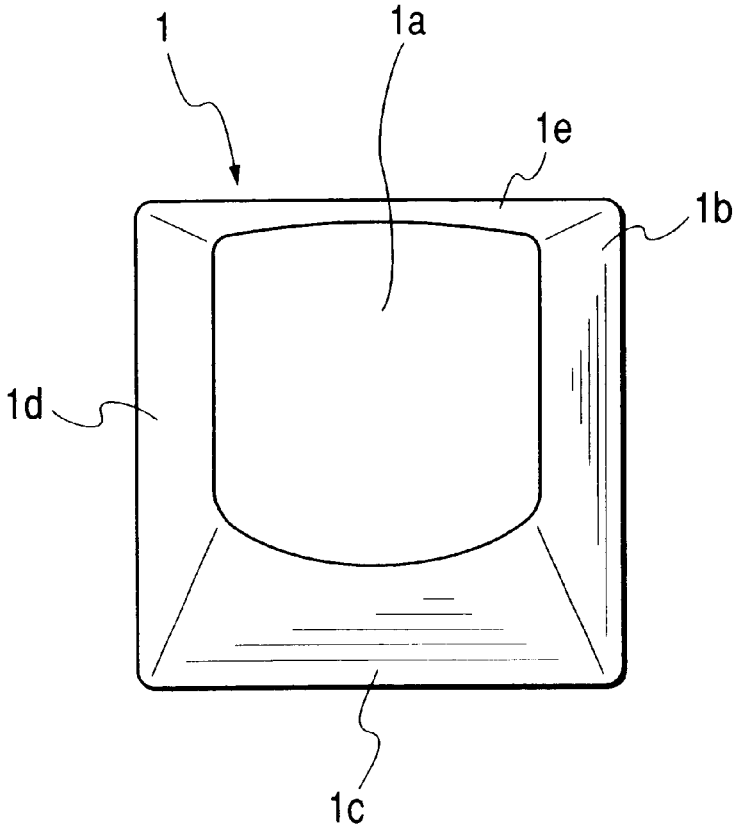
FIG. 1 is a top view of a key top of the present invention.
Figure 2:
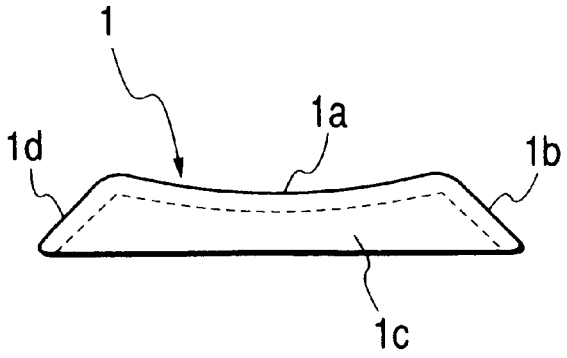
FIG. 2 is a front view of FIG. 1.
Figure 3:
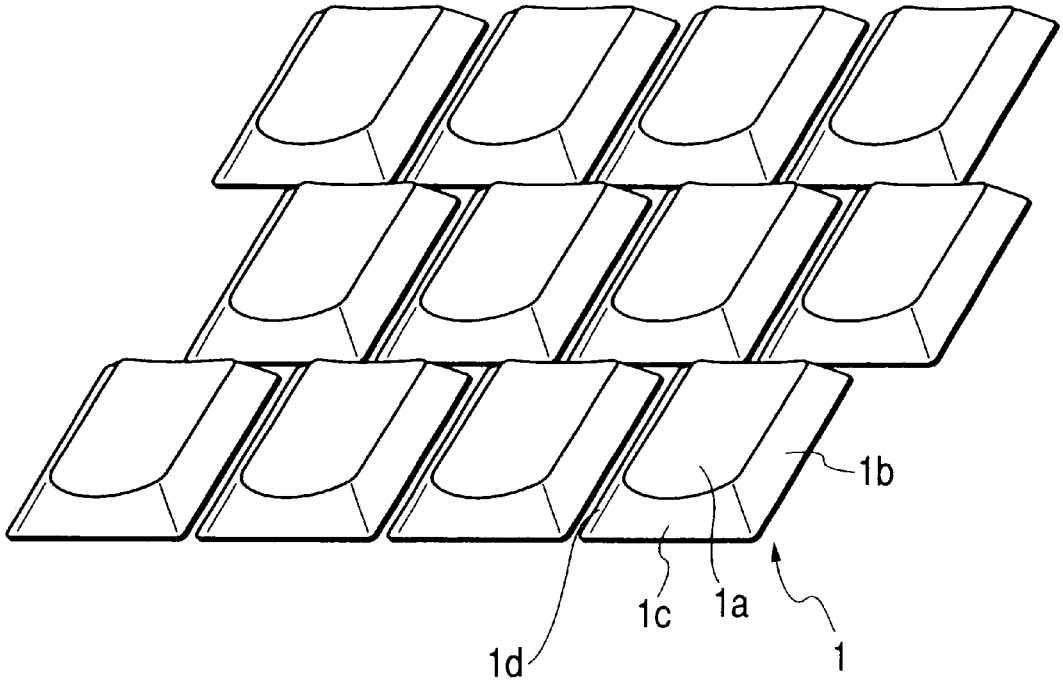
FIG. 3 is a perspective view of a plurality of key tops arranged of the present invention.

FIG. 1 is a top view of a key top according to the present invention; FIG. 2 is a front view of the key top; FIG. 3 is a perspective view showing a plurality of key tops arranged according to the present invention; and FIG. 4 is a sectional view showing a major portion of the key switch device according to the present invention.

Figure 4:
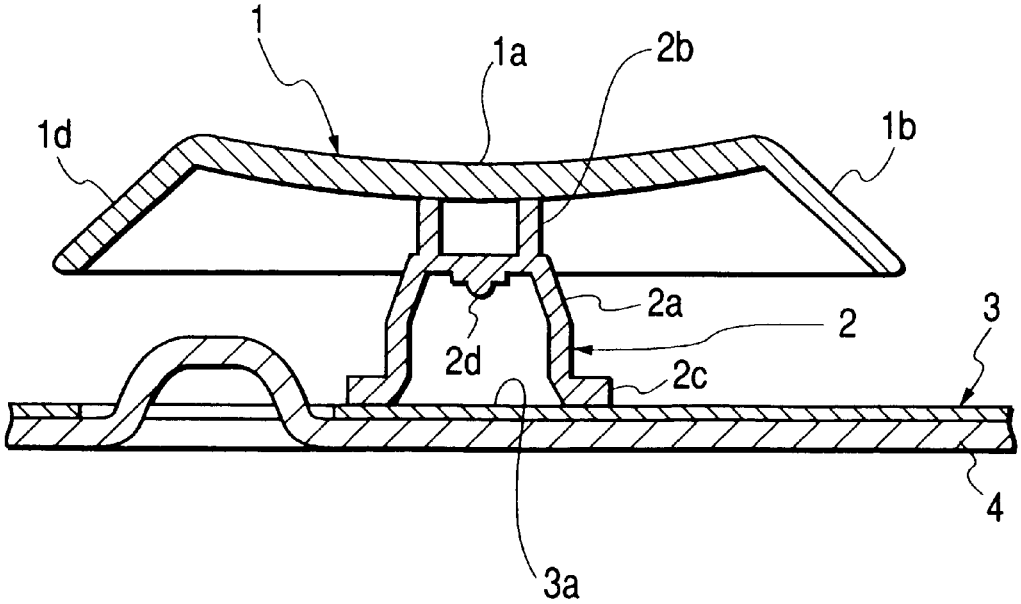
FIG. 4 is a sectional view showing a major portion of a key top according to the present invention.

In the key switch device of the present invention, an about 2 mm thick low-profile key top 1 is disposed in the upper position as shown in FIG. 4. The key top 1 is made of a synthetic resin such as the ABS resin, externally boat-shaped having an approximately trapezoidal form as shown in FIG. 2, and colored in different shades on the outer peripheral surface by printing.

The outer peripheral surface of the key top 1 has the upper top surface 1*a*, and four side surfaces, that is, right, left, front and rear side surfaces. The four right, left, front and rear side surfaces include mutually adjacent right side surface 1*b* and front side surface 1*c*, and mutually adjacent left side surface 1*d* and the rear side surface 1*e*.

The key top 1 is colored in different shades among mutually adjacent right side surface 1*b* and front side surface 1*c*, and mutually adjacent left side surface 1*d* and rear side surface 1*e*, and top surface 1*a*.

The right side surface 1*b* and front side surface 1*c* of the key top 1, as shown in FIG. 1, have a dark gray color for instance, in the black portion; the top surface 1*a*, a light gray color; and also the left side surface 1*d* and the rear side surface 1*e*, a medium gray color which is an intermediate color between the color of the right side surface 1*b* and the front side surface 1*c* and the color of the top surface 1*a*.

The key top 1, therefore, is colored dark gray on the right side surface 1*b* and shaded on the front side surface 1*c*; and the low-profile key top 1 looks thick because of a three-dimensional appearance.

At about the central part of the underside of the key top 1, there is disposed a dome-shaped elastic member 2 made of a rubber material. The elastic member 2 is comprised of a dome-shaped thin wall portion 2*a*, a ring-shaped top portion 2*b* protruding upwardly from the top of the wall portion 2*a*, and a collar-shaped bottom portion 2*c* formed on the outer periphery side of the underside of the wall portion 2*a*.

On the dome-shaped ceiling portion inside of the wall portion 2*a* under the top portion 2*b*, a projecting portion 2*d* is formed projecting downwardly to push the switch portion of the later-described membrane sheet 3 to thereby switch the contact point.

The top portion 2*b* of the elastic member 2 stated above is designed to be positioned nearly at the central part of the underside of the key top 1.

The key top 1 is supported at the underside by a vertically movable supporting member (not shown), and the top portion 2*b* of the elastic member 2 is positioned nearly at the central part of the underside.

When the operator depresses the key top 1 which is supported by the supporting member (not shown), the key top 1 can move up and down because of the elasticity of the elastic member 2.

The membrane sheet 3 installed under the elastic member 2 is formed by placing unillustrated upper sheet, spacer, and lower sheet in succession; the spacer serving to form a specific amount of clearance. In this state, an electrode on the upper sheet side and an electrode on the lower sheet side are oppositely arranged to form a switch portion 3*a*.

The bottom 2*c* of the elastic member 2 is attached by bonding to the membrane sheet 3 so that the projecting portion 2*d* of the elastic member 2 will be located above the switch portion 3*a*.

Under the membrane sheet 3 which is the lowermost part of the key switch device, a base plate 4 made of a metal plate is provided to thereby form the key switch device of the present invention.

The key switch device of the present invention thus constituted operates as follows. As shown in FIG. 4, when the operator depresses the top surface 1*a* of the key top 1 which is in up position, the key top 1 moves downwardly in perpendicular to the base plate 4.

As the top portion 2*b* of the elastic member 2 is pressed with the underside of the key top 1, the wall portion 2*a* is compressed to make elastic deformation (not shown). The elastic member 3 springs back when compressed to a specific depth, giving the key top 1 a tactile feedback.

The key top 1 is still kept depressed with an inertial force even after the tactile feedback feeling is produced, with the projecting portion 2*d* of the elastic member 2 pressing the switch portion 3*a* of the membrane sheet 3.

The upper and lower electrodes (not shown) of the membrane sheet 3 come into contact with each other, thus turning on the switch portion 3*a*. That is, the key top 2 moves downwardly and stops in the lower position thereof.

When the pressure is released from the key top 1, the elastic member 2 returns to the initial form with the elastic force of recovery of its own. Thus the projecting portion 2*d* goes upwardly off the switch portion 3*a* of the membrane sheet 3, to thereby turn off the switch portion 3*a*. At the same time the key top 1 is pushed upwardly to the upper position in the initial state.

The key switch device of the present invention is colored in different shades on the outer peripheral surface of the key top 1 as previously stated.

The key top 1 is colored dark on the right side surface 1*b* and the front side surface 1*c*; therefore if the light falls uniformly on the four sides of the key top 1, the right side surface 1*b* and the front side surface 1*c* look as if shaded. The key top 1, being low-profile, can give a thick, three-dimensional appearance. Therefore, the low-profile key switch device appears thick.

In the above-described embodiments of the present invention, a key top 1 colored in different shades on the outer peripheral surface has been explained. However, it should be noticed that the key top 1 may have different degrees of luster on the outer peripheral surface.

That is, the key top 1 may be provided with different degrees of luster: one on the mutually adjacent right side surface 1*b* and front side surface 1*c*, another on the mutually adjacent left side surface 1*d* and rear side surface 1*e*, and further another on the top surface 1*a*.

The right side surface 1*b* and front side surface 1*c* of the key top 1 are matted at the time of molding to decrease the luster; the top surface 1*a* is finished smooth to provide a high luster degree; and the left side surface 1*d* and rear side surface 1*e* are formed rough to provide an intermediate luster between the luster of the right side surface 1*b* and front side surface 1*c* and the luster of the top surface 1*a*.

The low-profile key top 1 thus provided with different degrees of luster on the outer peripheral surface is shaded on the matted right side surface 1*b* and front side surface 1*c* to thereby give a three-dimensional appearance.

The key switch device of the present invention, having the low-profile key top, looks thicker than an actual one, giving a three-dimensional appearance because of the colored outer peripheral surface and different shades of colors.

The key top is boat-shaped and has an approximately trapezoidal section. The outer peripheral surface of the key top includes the top surface and four side surfaces, that is, right, left, front, and rear side surfaces. Since the mutually adjacent right and side surfaces, the mutually adjacent left and rear side surfaces, and the top surface are colored in different shades, it is possible to provide a key switch device having the key top which looks thick, giving a three-dimensional appearance.

The right and front side surfaces of the key top are colored dark; the top surface has a light color; and the left and rear side surfaces are of an intermediate color between the color of the right and front side surfaces and the color of the top surface. The right and front side surfaces, therefore, appear shaded regardless of the direction of light falling on the key top. It is, therefore, possible to provide a key switch device which can look thicker than an actual one, giving even a low-profile key top with a three-dimensional appearance regardless of the direction of light.

Furthermore, the key switch device of the present invention has the key top and the membrane sheet for performing switching operation with the up-and-down movement of the key top. The key top has different degrees of luster on the outer peripheral surface, whereby even the low-profile key top appears three-dimensional so as to look thicker than actual ones.

Furthermore, the key top is externally boat-shaped in an approximately trapezoidal sectional form. The outer peripheral surface is comprised of the top surface and four side surfaces, that is, right, left, front, and rear side surfaces. Mutually adjacent right and front side surfaces, mutually adjacent left and rear side surfaces, and top surface are provided with different degrees of luster to thereby give the top key a three-dimensional appearance.

The luster can be varied by the use of a molding die in molding the key top, which will require no coloring, thereby enabling easy manufacture of the key top.

Furthermore, the right and front side surfaces of the key top are matted to lower the luster, and the top surface is made smooth to provide high luster, and the left and rear side surfaces are roughened to provide the intermediate luster between the luster of the right and front side surfaces and the luster of the top surface; therefore it is possible to provide a key switch device which gives the low-profile key top a thick, three-dimensional appearance.

What is claimed is:

1. A key switch device having at least one low-profile key top that is pressed to perform a switching operation, wherein the key top has a pyramidal frustum shape comprising a top surface and four outer peripheral side surfaces, said outer peripheral side surfaces comprising a proximal side surface, a right side surface, a left side surface and a back side surface as viewed from an operator, and further wherein the proximal side surface and the right side surface comprise a color shade that is different from a color shade of the left side surface and the back side surface so that the key top has an enhanced three-dimensional appearance as viewed from the operator.

2. A key switch device according to claim 1, wherein the top surface of the key top comprises a color shade that is different from the color shades of the proximal side surface, the right side surface, the left side surface and the back side surface so that the keytop has an enhanced three-dimensional appearance as viewed from the operator.

3. A key switch device according to claim 2, wherein the right side surface and the proximal side surface of the key top are colored in a first shade; the top surface is colored in a second shade; and the left side surface and the back side surface are colored in third shade; wherein the color of the first shade is darker than the color of the second shade, and the color of the third shade is between the color of the first shade and the color of the second shade.

4. A key switch device according to claim 1, wherein the right side surface and the proximal side surface of the key top are colored in a first shade, and the left side surface and the back side surface are colored in a second shade, wherein the color of the first shade is darker than the color of the second shade so that the key top has an enhanced three-dimensional appearance as viewed from the operator.

5. A key switch device according to claim 1, wherein the top surface of the key top comprises a concave surface.

6. A key switch device having at least one low-profile key top that is pressed to perform a switching operation, wherein the key top has a pyramidal frustum shape comprising a top surface and four outer peripheral side surfaces, said outer peripheral side surfaces comprising a proximal side surface, a right side surface, a left side surface and a back side surface as viewed from an operator, and further wherein the proximal side surface and the right side surface comprise a luster degree that is differentiated from a luster degree of the left side surface and the back side surface so that the key top has an enhanced three-dimensional appearance as viewed from the operator.

7. A key switch device according to claim 6, wherein the top surface of the key top comprises a luster degree that is differentiated from the luster degrees of the proximal side surface, the right side surface, the left side surface and the back side surface so that the key top has an enhanced three-dimensional appearance as viewed from the operator.

8. A key switch device according to claim 7, wherein the right side surface and the proximal side surface of the key top are matted to lower the luster degree; the top surface is provided with a smooth surface to improve the luster degree; and the left side surface and the back side surface are roughened to have an intermediate luster degree between the luster degree of the right side surface and the proximal side surface and the luster degree of the top surface.

9. A key switch device according to claim 6, wherein the right side surface and the proximal side surface of the key top are matted to lower the luster degree, and the left side surface and the back side surface are roughened to have a luster degree lower than the luster degree of the right side surface and the proximal side surface so that the key top has an enhanced three-dimensional appearance as viewed from the operator.

10. A key switch device according to claim 6, wherein the top surface of the key top comprises a concave surface.

* * * * *